US006442844B1

(12) United States Patent
Grunikiewicz et al.

(10) Patent No.: US 6,442,844 B1
(45) **Date of Patent: *Sep. 3, 2002**

(54) CUTTING KNIFE FOR CUTTING THROUGH ADHESIVE BEADS ON GLASS PANES OF VEHICLES

(75) Inventors: Peter Grunikiewicz; Bert G. Wurst, both of Stuttgart (DE)

(73) Assignee: C. & E. Fein GmbH & Co. (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/441,481

(22) Filed: Nov. 17, 1999

(30) Foreign Application Priority Data

Nov. 17, 1998 (DE) ..... 198 52 818

(51) Int. Cl.[7] ..... B26B 9/02; B26B 7/00
(52) U.S. Cl. ..... 30/272.1; 30/277.4
(58) Field of Search ..... 30/272.1, 123, 30/277.4, 315, 220; 29/275; 403/343

(56) References Cited

U.S. PATENT DOCUMENTS

| | | | | | |
|---|---|---|---|---|---|
| 2,681,502 | A | * | 6/1954 | Black | 30/2 |
| 3,448,517 | A | * | 6/1969 | Cothery | 30/140 |
| 3,924,327 | A | * | 12/1975 | Edwards | 30/277 |
| 4,080,734 | A | * | 3/1978 | Barbour | 30/277 |
| 4,215,475 | A | * | 8/1980 | Morford et al. | 30/277 |
| 4,300,287 | A | * | 11/1981 | Tibbs | 30/277 |
| 4,432,138 | A | * | 2/1984 | Piccolo, Jr. | 30/234 |
| 4,543,720 | A | | 10/1985 | Grunikiewicz et al. | |
| 4,587,733 | A | * | 5/1986 | Staempfli | 30/277 |
| 4,700,478 | A | * | 10/1987 | Mezger et al. | 30/294 |
| 4,980,976 | A | | 1/1991 | Junginger et al. | |

FOREIGN PATENT DOCUMENTS

| | | |
|---|---|---|
| DE | 33 24 676 C1 | 11/1984 |
| EP | 0 141 035 A1 | 10/1984 |
| EP | 0369 390 A2 | 5/1990 |

* cited by examiner

*Primary Examiner*—Hwei-Siu Payer
(74) *Attorney, Agent, or Firm*—St Onge Stewart Johnston & Reens LLC

(57) ABSTRACT

A cutting knife for a cutting tool for cutting through adhesive beads on glass panes of vehicles is disclosed having a cross section that is bent into a U-shape and comprises a first limb, configured as an attachment part, with a receiving opening for attachment to an oscillating drive, and a second limb that is configured as a cutting part and is joined via an intermediate part to the attachment part of the cutting knife. The intermediate part and the cutting part being shaped such that a distance exists in a radial direction between a center point of the receiving opening and at least one cutting edge. The cutting part has, in a middle region between its outer free end and its angled transition to the intermediate part, a width that is greater than the width at the transition.

10 Claims, 1 Drawing Sheet

CUTTING KNIFE FOR CUTTING THROUGH ADHESIVE BEADS ON GLASS PANES OF VEHICLES

BACKGROUND OF THE INVENTION

The present invention relates to a cutting knife for a cutting tool for cutting through adhesive beads on glass panes of vehicles, having a cross section that is bent into a U-shape and comprises a first limb, configured as the attachment part, with a receiving opening for attachment to an oscillating drive, and a second limb that is configured as the cutting part and is joined via an intermediate part to the attachment part of the cutting knife, the intermediate part and the cutting part being shaped such that a distance exists in the radial direction between the center point of the receiving opening and at least one cutting edge.

Cutting knives of this kind bent into a U-shape are known, for example, from DE 33 24 676 C1 or from EP 0 141 035 B1: the former discloses a cutting part, curved in a sickle shape, that is curved convexly with respect to the clamping point; while the latter discloses a cutting part, curved in a sickle shape, that is curved concavely with respect to the clamping point.

Also known from EP 0 369 390 A2 is a cutting knife having a straight cutting part.

Cutting knives of this kind are used to detach glass panes that are adhesively bonded onto motor vehicles using an adhesive bead. This may involve, for example, a windshield that is adhesively bonded onto the A-pillar of a motor vehicle using an adhesive bead around the entire periphery. The adhesive bead is applied continuously between the body flange and the side of the glass pane facing toward the vehicle interior, and is usually made of a special polyurethane. Windshields adhesively bonded in this fashion additionally impart improved mechanical passenger compartment stability to the vehicle. It is understood that for this reason, the adhesive bead is made of a particularly tough and strong material that presents a great deal of resistance to removal of the windshield. Depending on the adhesive material used, the adhesive bead can also exhibit a certain porosity and, in particular, can possess sufficient toughness that normal cutting is possible only with difficulty even with the use of the oscillating drive, which as a rule oscillates at high frequency (on the order of approximately 5,000 to 25,000 oscillations per minute) and with a small pivot angle (between approximately 0.5 and 5°).

SUMMARY OF THE INVENTION

It is an object of the invention to improve a cutting knife of the kind cited initially in such a way that even adhesive beads that are made of a particularly tough and resilient material can be cut through with relatively little energy expenditure.

This object and other objects are achieved, in the case of a cutting knife of the kind cited initially, in that the cutting part has, in a middle region between its outer free end and its angled transition to the intermediate part, a width that is greater than the width at the transition to the intermediate part.

The object of the invention is completely achieved in this fashion.

Specifically, it has been found that because the cutting part initially widens outward from the transition to the intermediate part, a kind of chopping effect occurs which facilitates cutting through the particularly tough materials that are most recently being used.

According to another embodiment of the invention, the cutting part has a first edge, facing toward the receiving opening and convexly curved with respect thereto, and a second edge, facing away from the receiving opening and concavely curved with respect thereto, at least one of the edges being configured as a cutting edge.

According to a further feature of the invention, the cutting part has a first edge, facing toward the receiving opening and straight or concavely curved with respect thereto, and a second edge, facing away from the receiving opening and concavely curved with respect thereto, at least one of the edges being configured as a cutting edge.

According to a further embodiment of the invention, the cutting part has a first edge, facing toward the receiving opening and convexly curved with respect thereto, and a second edge, facing away from the receiving opening, that is straight or is convexly curved with respect to the receiving opening, at least one of the edges being configured as a cutting edge.

According to a further embodiment of the invention, the cutting part is shaped so that the radial distance to the center point of the receiving opening increases from the transition out toward the outer end.

This feature helps to utilize the oscillation stroke itself for the cutting effect, since with each oscillation stroke the cutting part cuts further into the material that is to be cut through.

According to a further feature of the invention, the cutting part has two cutting edges that meet each other to form a tip at its outer end.

This facilitates insertion of the cutting knife through the adhesive bead at the beginning of the removal operation.

According to a further embodiment of the invention, the cutting part has a cutting edge on its side facing away from the receiving opening, and has on its side facing toward the receiving opening an edge that is configured as a blunt back.

The result of this feature is that the cutting part as a whole has a greater mass, thus increasing the kinetic energy of an oscillation stroke; this makes it easier to cut through particularly tough or porous materials.

It is understood that the features of the invention mentioned above and those yet to be explained below can be used not only in the respective combinations indicated, but also in other combinations or in isolation, without leaving the context of the present invention.

SHORT DESCRIPTION OF THE DRAWINGS

Further features and advantages of the invention are evident from the description below of preferred exemplary embodiments with reference to the drawings, in which.

DETAILED DESCRIPTION OF THE PREFERRED EMBODIMENTS

Figure 1:
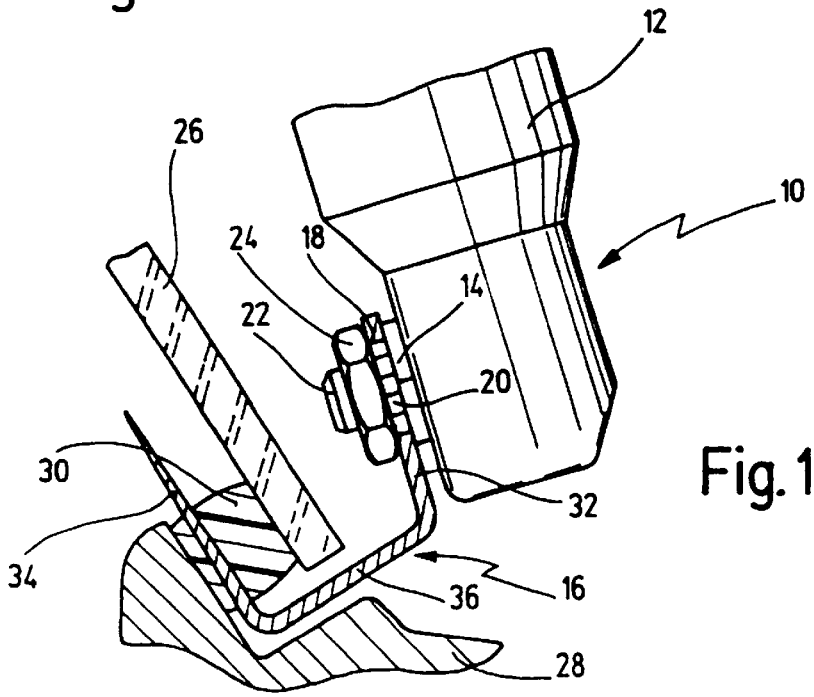
FIG. 1 shows a sectioned representation of the cutting knife according to the present invention, being used with an oscillating drive.

In FIG. 1, a cutting tool according to the present invention is labeled in its entirety with the number 10.

Figure 2:
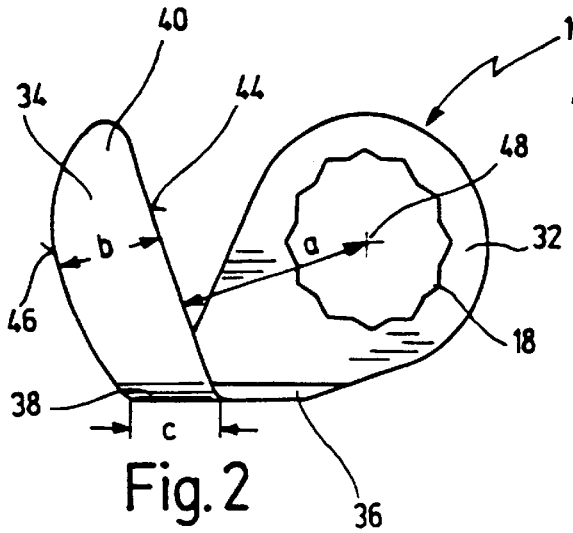
FIG. 2 shows a view of a cutting knife according to the present invention, in a somewhat enlarged representation.

The cutting tool 10 comprises an oscillating drive 12 on whose drive shaft 14 is received a cutting knife bent into a U-shape, labeled in its entirety with the number 16, that is positively received with a receiving opening 18 (configured in a dodecagonal shape as shown in FIG. 2) on a correspondingly shaped polygonal member 20 of drive shaft 14 and is secured, for example, by way of a nut 24 that is screwed onto a threaded stud 22 of drive shaft 14.

As already mentioned, cutting knife 16 is bent into a U-shape in cross section and is joined to drive shaft 14 with its first limb, which is configured as attachment part 32. Attachment part 32 is joined via an intermediate part 36 to the second limb of the U-shape, which is configured as cutting part 34.

Whereas cutting part 34 and intermediate part 36 enclose between them an angle of approximately 90°, attachment part 32 encloses with spacing plate 36 an angle somewhat greater than 90°, preferably approximately in the range between 93° and 100°.

Cutting tool 10 is shown in FIG. 1 in its working position, in which by way of cutting part 34 it is possible to cut through an adhesive bead 30 with which a glass pane 26 is continuously adhesively bonded, on its side facing toward the vehicle interior, to a body flange 28.

The particular configuration of the cutting knife according to the present invention will be explained in more detail below with reference to FIGS. 2 through 5.

As shown in FIG. 2, cutting part 34 possesses a first straight cutting edge 44 on its side facing toward receiving opening 18. The distance between a center point 48 of receiving opening 18 increases toward the outer end 40 of cutting part 34. In other words, cutting part 34 is angled with respect to receiving opening 18 in such a way that toward the outside it becomes farther away from receiving opening 18.

On its side facing away from receiving opening 18, cutting part 34 has a further cutting edge 46 that transitions at its outer end 40, via a rounded segment, into first cutting edge 44.

In a middle region of cutting part 34 between the cutting part's transition 38 to spacing plate 36 and outer end 40, cutting part 34 possesses a width b that is greater than width c in the region of transition 38 to spacing plate 36. In other words, the cutting part widens outward from spacing plate 36 before once again narrowing toward its outer end 40.

Figure 3:
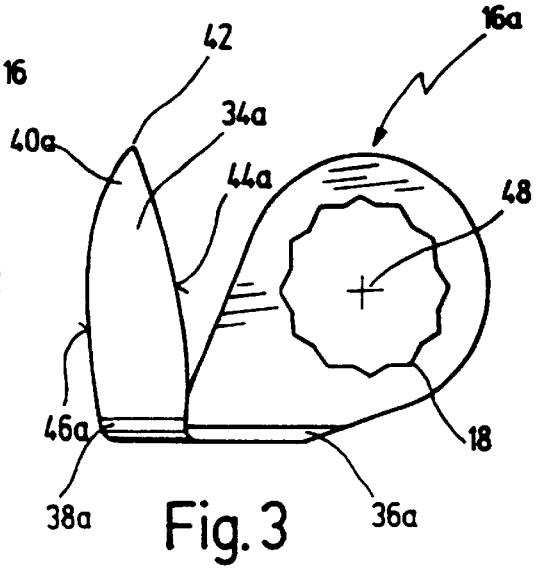
FIG. 3 shows a view of a modification of the cutting knife.

A modification of the cutting knife shown in FIG. 2 is shown in FIG. 3 and is labeled in its entirety with the number 16*a*. Corresponding reference numbers are used for corresponding parts.

On its side facing toward the attachment opening, cutting part 34*a* possesses a cutting edge 44*a* that is convexly curved with respect to attachment opening 18. On its side facing away from attachment opening 18, cutting part 34*a* possesses a cutting edge 46*a* that is concavely curved with respect to attachment opening 18. The two cutting edges 44*a*, 46*a* come together to form a tip 42 at outer end 40*a*.

This tip 42 facilitates the insertion of cutting knife 16*a* through adhesive bead 30 when beginning work.

Cutting part 34*a* once again has a greater width in a middle region than at its transition 38*a* to intermediate part 36*a*.

Figure 4:
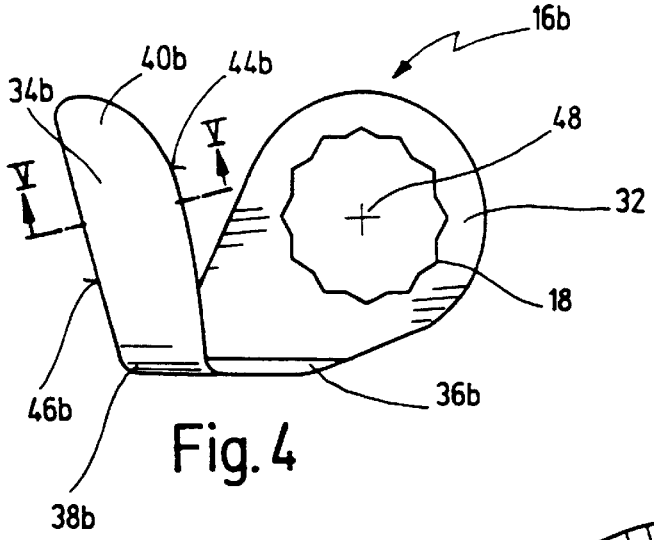
FIG. 4 shows a view of a further modification of the cutting knife according to the present invention.

A further modification of the cutting knife according to the invention is shown in FIG. 4 and is labeled in its entirety with the number 16*b*.

In this case cutting part 34*b* has a straight cutting edge 46*b* only on its side facing away from attachment opening 18, whereas cutting part 34*b* possesses on its side facing toward attachment opening 18 an edge 44*b* that is configured as a blunt back.

Figure 5:
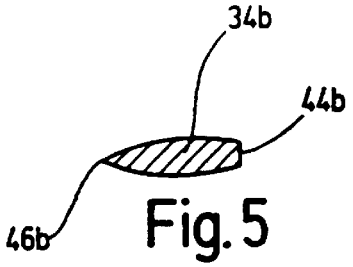
FIG. 5 shows a section through the cutting part of the cutting knife shown in FIG. 4, along line V—V.

The result is an approximately wedge-shaped cross-sectional shape of cutting part 34*b*, as is evident from FIG. 5.

Cutting part 34*b* once again has a greater width in a middle region than at its transition 38*b* to intermediate part 36*b*.

What is claimed is:

1. A cutting knife for cutting tools for cutting through adhesive beads on glass panes, said cutting knife being of angular U-shaped configuration and comprising:

an attachment part having a receiving opening for attachment to a drive shaft of an oscillating drive and forming a first U-leg;

an intermediate part adjoining said attachment part and forming a central U-leg;

a cutting part forming a second U-leg, said cutting part having an angled transition to said intermediate part and having a middle region adjoining said angled transition, said cutting part having a first edge facing toward said receiving opening and a second edge facing away from said receiving opening, a distance between said first edge and said second edge varying from a first width being defined proximate to said angled transition and a second width being defined within said middle region, said second width being larger than said first width;

wherein said second width being wider than said first width defines an outwardly curved contour of said second edge for simulating a chopping effect that facilitates cutting; and said cutting part being displaced radially with respect to a center point of said receiving opening.

2. The cutting knife as defined in claim 1, wherein said first edge is convexly curved with respect to said receiving opening, and wherein said second edge is concavely curved with respect to said receiving opening, wherein at least one of said edges is configured as a cutting edge.

3. The cutting knife as defined in claim 2, wherein said second edge comprises said cutting edge, and said first edge comprises an edge configured as a blunt back.

4. The cutting knife as defined in claim 1, wherein said first edge is concavely curved with respect to said receiving opening, and wherein said second edge is concavely curved with respect to said receiving opening, at least one of said first and second edges being configured as a cutting edge.

5. The cutting knife as defined in claim 1, wherein said first edge extends straight, said second edge is concavely curved with respect to said receiving opening, at least one of said first and second edges being configured as a cutting edge.

6. The cutting knife as defined in claim 1, wherein said first edge is convexly curved with respect to said receiving opening, and wherein said second edge is convexly curved with respect to the receiving opening, at least one of said first and second edges being configured as a cutting edge.

7. The cutting knife as defined in claim 1, wherein said first edge is convexly curved with respect to said receiving opening, and wherein said second edge extends straight, at least one of said first and second edges being configured as a cutting edge.

8. The cutting knife as defined in claim 1, wherein said cutting part defines a radial distance from said center point of said receiving opening, said radial distance increasing from said angled transition outwardly toward an outer end of said cutting part.

9. The cutting knife as defined in claim 1, wherein said first and second edges comprise two cutting edges that meet at an outer end to form a tip.

10. The cutting knife as defined in claim 1, wherein said second edge comprises a cutting edge, and said first edge comprises an edge configured as a blunt back.

* * * * *